United States Patent [19]

Nagata et al.

[11] 4,455,148

[45] Jun. 19, 1984

[54] METHOD FOR DE-ASHING AND TRANSPORTATION OF COAL

[75] Inventors: Kenichi Nagata, Yachiyo; Shigeru Nagamori, Ichihara; Yuuichi Katoh, Ichihara; Katsumi Satoh, Ichihara; Takashi Yano, Ichihara, all of Japan

[73] Assignee: Mitsui Engineering & Shipbuilding Co., Ltd., Tokyo, Japan

[21] Appl. No.: 366,996

[22] Filed: Apr. 9, 1982

[30] Foreign Application Priority Data

Apr. 9, 1981 [JP] Japan ..... 56-52421

[51] Int. Cl.[3] ..... C10L 5/16

[52] U.S. Cl. ..... 44/1 SR; 44/24; 44/23; 209/49; 209/164; 209/173

[58] Field of Search ..... 44/1 SR, 24, 23; 209/207, 49, 171, 173, 164

[56] References Cited

U.S. PATENT DOCUMENTS

| | | | |
|---|---|---|---|
| 4,272,250 | 6/1981 | Burk, Jr. et al. | 44/1 SR |
| 4,282,004 | 8/1981 | Masologites | 44/24 |
| 4,302,209 | 11/1981 | Baker et al. | 44/23 |
| 4,331,447 | 5/1982 | Kamada et al. | 44/24 |

*Primary Examiner*—Delbert E. Gantz
*Assistant Examiner*—Anthony McFarlane
*Attorney, Agent, or Firm*—Armstrong, Nikaido, Marmelstein & Kubovcik

[57] ABSTRACT

A method for de-ashing crushed coal and transporting it in the form of pellets, said method comprising the following steps:

A. the step of mixing pulverized coal with a binder to cover the surfaces of coal particles with the binder;
B. the step of adding water to the pulverized coal;
C. the step of stirring the slurry to disperse ash particles in the pulverized coal into water and to agglomerate coal particles in the pulverized coal by tumbling, whereby forming pelletized coal; and
D. the step of separating the pelletized coal from the ash particles, and transporting the pelletized coal.

The above basic four steps may be combined with the following steps depending on the state and particle size of raw coal:

E. the step of crushing raw coal and separating it into high-ash coal and purified crushed coal, and further pulverizing the purified crushed coal and supplying the resulting powder to the above step A; and
F. the step of separating by gravity separation the pellets obtained in the above step D into high-ash pellets and purified pellets, and transporting the resulting purified pellets.

14 Claims, 22 Drawing Figures

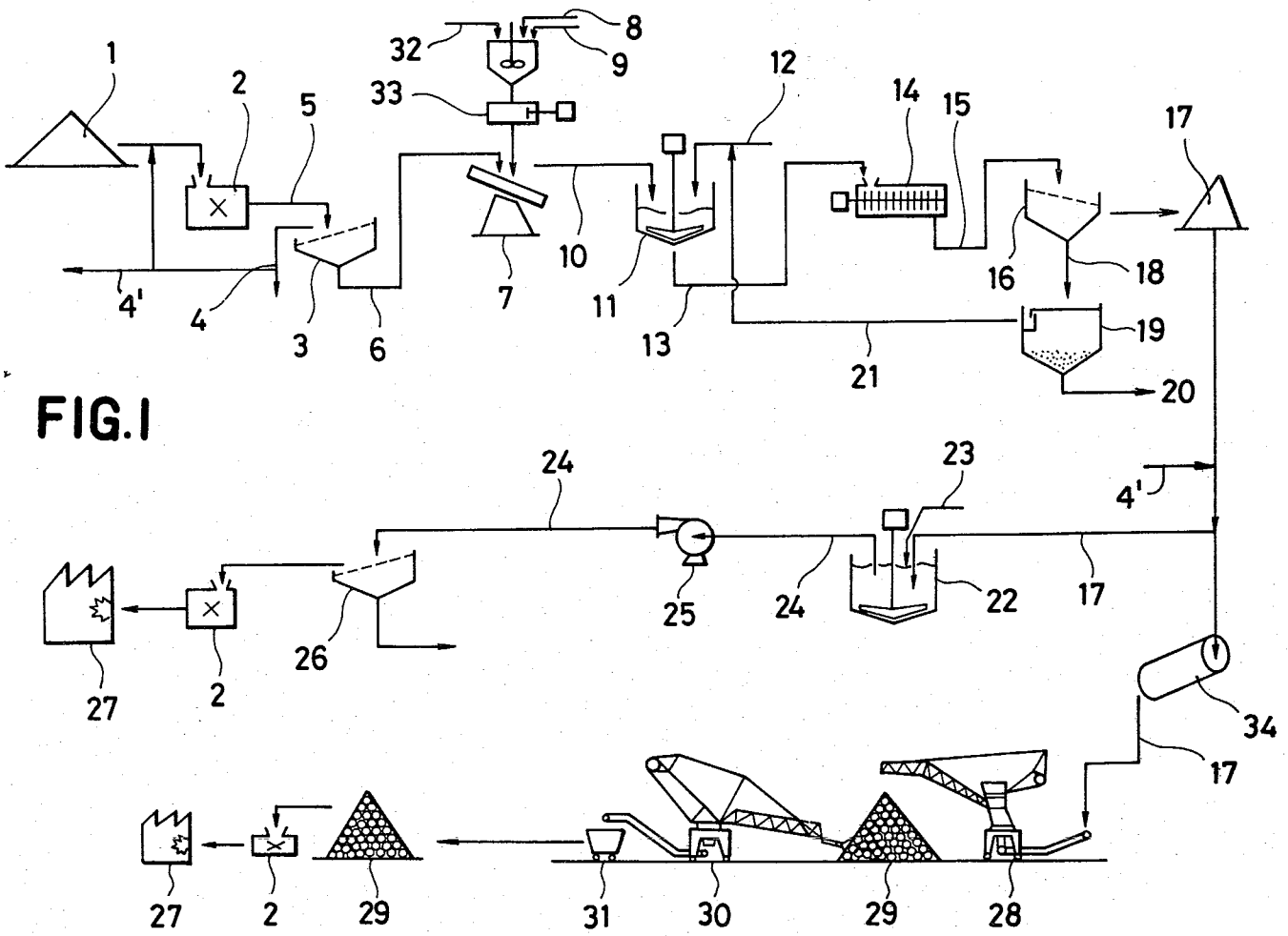
FIG. I

METHOD FOR DE-ASHING AND TRANSPORTATION OF COAL

BACKGROUND OF THE INVENTION

The present invention relates to a method for de-ashing and transportation of coal. More particularly, the present invention relates to a method for crushing, pelletizing, and de-ashing coal at coal mines and then transporting coal through slurry pipeline systems or bulk shipments by trains, trucks, conveyors, etc.

The known methods for coal shipments include (1) slurry transportation in which pulverized coal is slurried in water and transported through pipelines and (2) bulk shipments in which coal is handled in the form of lumps.

According to the slurry transportation method, coal is pulverized to an average particle size of about 0.1 mm and slurried in water and the coal slurry is transported through pipelines to the place of consumption. This method, however, has the following disadvantage. In order for the slurry to be stable enough to prevent coal particles from settling in the pipeline, the slurry should contain about 20% of fine coal particles less than 40 microns in size. If slurry is therefore made containing fine coal particles, by this the slurry can be made having an improved stability, but dewatering of the slurry is then made difficult as a matter of course, so that it is unavoidable in this case to carry out a powerful dewatering step at the destined place of consumption: For example, a slurry transported through a pipe line is put for a solid-liquid separation by a centrifugal separator, but there still tends to remain fine particles suspended in the separated liquid, so that it further is operated to pass the separated liquid through a thickener and to further refine it through a waste-water refining apparatus.

As pointed out above, to directly slurry fine coal particles involves the serious shortcoming of being accompanied by an extreme difficulty for dewatering.

On the other hand, the shipping of lump coal requires troublesome, costly loading and unloading and measures for environmental pollution with dust and spontaneous combustion during storage.

Coal contains rocks and soil, and transporting them altogether is uneconomical. To solve these problems, the following methods have been proposed. (A) Removing rocks from coal by gravity separation. (B) Adding fuel oil or light oil to the coal slurry at the terminal of a pipeline system, whereby performing de-ashing and pelletization based on the principle of oil agglomeration in water (abbreviated as OAW hereinafter). (C) Adding water to a coal-oil mixture, whereby removing ash caught by water.

The method (A) requires a coal dressing plant with additional cost for equipment and labor, and yet has the problem unsolved in the dewatering of slurry.

The method (B) has inherent demerits mentioned below.

(1) It is impossible to control the OAW operating conditions according to the fluctuation of coal rank. The rank of coal fluctuates even in the same coal mine, and the ash content and lipophilic property of coal vary accordingly. OAW utilizes the lipophilic property of coal, and the oil to be added should be controlled according to the rank of coal. However, this is impracticable in view of the fact that tens of thousand tons of coal is flowing in the pipe at all times. Even though the fluctuation of coal rank is found at the entrance of the OAW facility, it is impossible to cope with the time lag. As the result, slurry water is discharged, with agglomeration remaining incomplete. This might lead to water pollution with fine coal particles.

(2) It is impossible to add oil in a proper quantity according to the pulverization of coal that occurs during slurry transportation. The quantity of oil to be added in the OAW process should be changed according to the particle size of coal powder, and the more the fine powder, the more the oil required. The ratio of pulverization varies depending on the rank of coal, but it is very difficult to estimate it beforehand.

(3) The OAW process requires a great deal of powder and time and an apparatus of infeasibly large volume. For instance, if five million tons of coal is to be transported per year, the OAW apparatus would have to have a flow rate of 2000 $m^3/h$, assuming 30 wt % solids in the slurry. Such an apparatus would be 1000 to 2000 $m^3$ in volume and require 4000 to 12000 kW for agitation, assuming a power consumption of 2 to 6 kW.h for 1 $m^3$ of slurry, according to the inventors' calculations.

(4) The OAW process, which is intended to separate pure coal by agglomeration from ash in pulverized raw coal, has an inherent demerit that it cannot separate ash particles enclosed by pure coal. This is the reason why the de-ashing ratio was 30 to 40% with the conventional OAW process.

Finally, the method (C) is not economical because the oil used more than 50 wt % based on coal is eventually burned. Using oil in such a large amount goes against the times when replacement of petroleum by coal is being advocated.

SUMMARY OF THE INVENTION

A first object of the present invention, which has been completed to overcome the above-mentioned disadvantages, is to provide a method for de-ashing and transportation of coal which can be controlled irrespective of the fluctuation of coal rank.

A second object of this invention is to provide a method for de-ashing and transportation of coal which can be used in combination with each other according to the fluctuation of coal rank and can be controlled irrespective of fluctuation of hardness and pulverizability of coal.

A third object of this invention is to provide a method for de-ashing and transportation of coal which saves the consumption of binder oil by 40 to 60% as compared with the conventional OAW process.

A fourth object of this invention is to provide a method for de-ashing and transportation of coal which can be carried out with much less power consumption than the conventional OAW process.

A fifth object of this invention is to provide an effective method for coal de-ashing.

A sixth object of this invention is to provide a method for de-ashing and transportation of coal which can be applied to coal of any variety.

The method of this invention comprises the steps of mixing pulverized coal with a binder to cover the surfaces of coal particles with the binder, adding water to the pulverized coal to form coal slurry, stirring the slurry to disperse ash particles in the pulverized coal into water and to agglomerate coal particles in the pulverized coal by tumbling, whereby forming pelletized coal, separating the pelletized coal from the ash particles, and transporting the pelletized coal. Depending on the ash content in raw coal, the method is preceded by the pretreatment to separate the crushed coal into high-ash crushed coal and pure crushed coal by gravity separation and subsequently pulverize the pure crushed coal, in the case where raw coal contains about 30 to 50% of ash and ash particles greater than 1 mm, and/or the method may be followed by the post-treatment to separate the pelletized coal into high-ash pellets and pure pellets by gravity separation in the case where raw coal contains less than 30% of ash and ash particles smaller than 1 mm.

BRIEF DESCRIPTION OF THE DRAWINGS

FIG. 1 is a flow diagram illustrating Example 1 of this invention;

DETAILED DESCRIPTION OF THE INVENTION

Figure 2A:
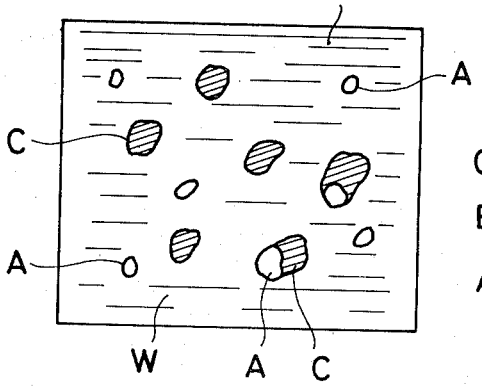
FIGS. 2A to 2D are enlarged schematics illustrating the principle of pelletizing coal particles by the conventional OAW process.

The invention is illustrated with reference to the following Examples.

The process of Example 1 is shown in FIG. 1. According to this process, pulverized coal particles are coated with a binder and pelletized in water, while hydrophilic ash particles are dispersed into water, whereby de-ashing is accomplished. The process of Example 1 is fundamental to the processes of Examples 2 to 4. It is applicable to raw coal containing less than 15% of ash, such as bituminous coal, sub-bituminous coal, and brown coal.

In FIG. 1, the raw coal 1 is crushed to a desired particle size by the crusher 2 which is a cage mill, rod mill, or ball mill. The particle size is selected properly in relation to the de-ashing ratio. If coal is pulverized to particles finer than 50 microns, more than 50% of ash can be removed in the subsequent de-ashing step. As the particle size becomes finer, more binder is required for the same quantity of coal. If coal is pulverized to coarse particles of 0.7 mm on average and finer than 5 mm, the quantity of binder required is about 5 wt % but the de-ashing ratio decreases to 35 to 45%. Thus, the particle size should be determined according to the de-ashing ratio or the quantity of binder, whichever is important from the standpoint of end use of coal. According to the inventors' economical estimate, the above-mentioned coarse particle size of 0.7 mm on average and finer than 5 mm is recommended.

In the downstream of the crusher 2 is arranged the classifier 3 which separates coarse coal particles 4 from the crushed raw coal 5, permitting fine coal particles 6 to be transferred to the subsequent pelletizing step.

According to another method which is preferably adopted to improve the overall economy of the invention, raw coal is crushed by the crusher to particle size of 0.7 mm on average and finer than 7 mm, and particles smaller than 0.5 mm are separated by a classifier and then pelletized. The pelletized coal is mixed with coal particles 4' of 0.5 to 7 mm in size to make the final product. This process is advantageously applied to coal of low ash content which is not pulverized easily during transportation.

The fine coal 6, with coarse particulate coal 4 removed, is fed to the pelletizer 7 in which the fine coal 6 is mixed with the binder 8 which is described later. The atmosphere in the pelletizer 7 should preferably be replaced by nitrogen for brown coal which rapidly oxidizes during operation.

The binder 8 is selected from coal tar, artificial petroleum obtained from coal, fuel oil, and asphalt obtained from petroleum, which are readily available at low prices and are effective for agglomeration of fine coal particles. When in use, the binder is heated to adjust the viscosity properly.

The quantity of the binder 8 to be added is determined according to the particle size of crushed coal as above-mentioned; at least 20 wt % is required when particle size is smaller than 50 microns, and about 5 wt % will be sufficient for coal particles of about 0.7 mm on average. The average particle size of 0.7 mm is preferably used according to the inventors' economical estimate.

The binder 8 is preferably incorporated with a surface active agent 9 which is effective to reduce the quantity of the binder 8 to be added and to shorten the pelletizing time. Some examples of the surface active agent 9 are shown below.

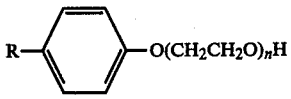

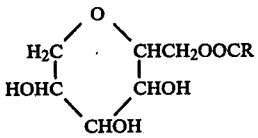

$R—COO—(CH_2CH_2O)_nH$ (where R is an alkyl group of $C_6$ to $C_{20}$, and n is an integer from 1 to 30.)

This surface active agent is added in an amount from 0.05 to 0.2 wt % based on raw coal.

The binder 8 incorporated with the surface active agent 9 may be further incorporated with approximately the same quantity of water 32, and the binder 8 is dispersed into water in the form of fine particles in the order of microns. For dispersion, the supersonic emulsifier 33 is preferably used.

The binder may contain 30 to 60 wt % of coal powder finer than 10 microns in addition to the surface active agent.

The fine coal powder for such incorporation may comprise any of the pelletized coal particles according to the Example 1 of the present invention, the purified pellets according to Examples 2 and 3 to be later described, and the pelletized particles according to Example 4 of the invention and pulverized to a particle size below 10 μ.

The dry pelletizer 7 is preferably a Henschel type powder mixer or an inclined tumbling disc mixer with an eccentric rotary rake which is intended for mixing solids.

In the pelletizer 7, the binder is dispersed among the coal particles so that the binder uniformly covers the surface of the coal particles. During this process, coal particles lose the oxidized layer on the surface due to friction between coal particles, and water on the surface of coal particles is replaced by the binder.

The residence time in the pelletizer 7 is usually 3 to 10 minutes and the agitator blade is turned at a peripheral velocity of 3 to 30 m/s.

The binder 8 may be charged into the pelletizer 7 all at once, or charged by spraying from a nozzle while the coal powder is stirred. The latter method is preferable for uniform dispersion and rapid coating onto the surface of coal particles.

As the result of the above-mentioned step, the surfaces of the coal particles are coated with a thin film of the binder.

The binder-coated coal particles 10 are charged to the mixer 11, into which water 12 is added to yield the coal slurry 13 containing 30 to 60 wt % of solids.

If the solid content of the coal slurry is less than 30 wt %, agglomeration takes a longer time because coal particles are less likely to collide with each other in the forming machine 14. In addition, power is wasted to stir water needlessly.

If the solid content of the coal slurry is higher than 60 wt %, free release of ash particles is prevented and the slurry lacks flowability when supplied to the forming machine 14. The mixer 11 is usually a vessel-type mixer with a vertical stirrer.

The coal slurry 13 obtained in the above step is then fed to the wet-type forming machine 14, in which coal particles coated with the binder film are caused to agglomerate as if oil droplets dispersed in water agglomerate, while hydrophilic ash particles release the binder film and the resulting bare ash particles disperse into water.

The forming machine 14 is usually a vessel-type mixer with a stirrer, and a vertical or horizontal cylindrical mixer with a multi-blade stirrer is also preferably used. The residence time in the forming machine 14 is usually about 3 to 15 minutes and the blade is turned at a peripheral velocity of 6 to 30 m/s.

In the first half (at the inlet side) of the forming machine 14, the high shear force generated by the stirring blades strips off the binder film from ash particles and disperses the resulting bare ash particles into water, and simultaneously, agglomerates coal particles coated with the binder film.

In the second, half (af the outlet side) of the forming machine 14, the centrifugal force generated by the stirring blades causes the coal agglomerates to tumble, under the pressing force against the inside wall of the cylinder. The coal agglomerates finally become spherical pellets.

The slurry 15 containing pellets and ash particles is then passed through the screen having 0.3 to 0.7 mm openings. The oversize particles are pellets of 0.3 to 0.5 mm and up in particle diameter, and the undersize particles are ash particles dispersed in the slurry 18.

The ash particle slurry 18 is separated into ash particles 20 and clear water 21 by the solid-liquid separator 19. A precipitator used for treatment of clay-containing waste water may be used as the solid-liquid separator 19.

The clear water 21 is recycled to the mixer 11 after being combined with replenishing water 12.

The ash particles 20 are used, after dewatering, to fill up the spaces left after mining.

The pellets 17 prepared in the above steps are mixed with water 23 in the conditioning vessel 22 to make the slurry 24 of proper solid content, say 30 to 50 wt %, which is suitable for transportation to the place of consumption by the pump 25.

At the terminal of the pipeline, the pellets are dewatered by the solid-liquid separator 26 prior to combustion. Being hydrophobic, the pellets are dewatered easily.

The pellets can be burned in the conventional pulverized coal burner 27 after re-crushing to a desired particle size by the crusher 2. Also, the pellets can be burned as received in a fluidized bed boiler (not shown).

In slurry transportation, the slurry pumps 25, which may be common sand pumps, are installed at intervals of 100 km. The pellets 17, which are not crushed under agitation by the stirring blade at a peripheral velocity of 5 to 30 m/s in the forming machine 14, are not crushed as a matter of course when they pass through the pump 25 and the pipeline 24.

If a 0.3 to 1 mm vibrating screen is used as the solid-liquid separator, it is possible to reduce the water content of the pellets 17 to 12 wt %. If a cage-type centrifugal separator of about 100G is used, it is possible to reduce the water content to 7 wt % or less.

Instead of slurry transportation through pipeline 24, the pellets may be shipped by sea or land. For bulk shipment by sea or land, the pellets 17 are passed through the dryer 34, if required, for water content adjustment, and then piled up (29) by the stacker 28 at the open-air storage yard.

The pellets 29 piled up at the open-air storage yard are loaded by a reclaimer 30 onto freight cars 31. At the destination, the pellets 29 are piled up again at the open-air storage yard and then fed to the crusher 2 and boiler 27. The pellets as received can be burned in a fluidized bed boiler.

If pellets are to be transported by water after slurry transportation through ground pipelines, the slurry may be dewatered by screens prior to loading and the loaded slurry may be dewatered through screens at the bottom of the ship's hold, so that carrying unwanted water is avoided.

The process of this invention as shown in FIG. 1 is further described theoretically in comparison with the conventional OAW method.

FIGS. 2A to 2D illustrate the principle of the OAW method, and FIGS. 3A to 3D illustrate the principle of the present invention.

FIG. 2A schematically shows coal slurry composed of water W and coal particles C and ash particles A suspending therein.

Figure 2B:
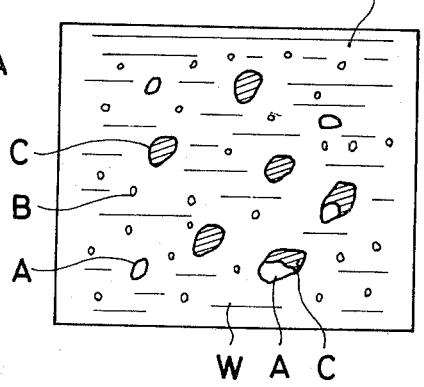
Figure 2C:
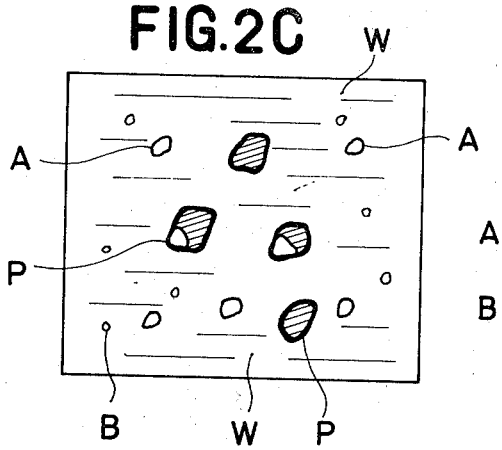
Figure 2D:
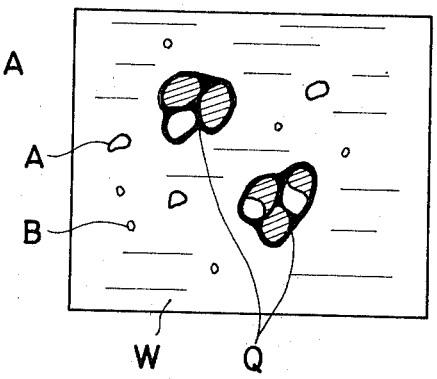

When a binder is added to the slurry, the binder in the form of droplets B disperses among coal particles B and ash particles A as shown in FIG. 2B. The binder droplets B stick selectively to lipophilic coal particles A, forming coated coal particles P, as shown in FIG. 2C. The coated coal particles P agglomerate as shown in FIG. 2D, and the agglomerates form pellets Q when tumbled in water.

On the other hand, hydrophilic ash particles A remain suspended in water, and finally pellets Q are sieved out from the slurry containing ash particles.

It is to be understood from this principle that the conventional OAW method is dependent on the degree of lipophilic property of coal. Therefore, the conventional OAW method cannot pelletize brown coal having no lipophilic property, and involves problems such as low yields of pellets and increased transfer of binder to ash slurry, which all result from the lipophilic property of coal.

Figure 3A:
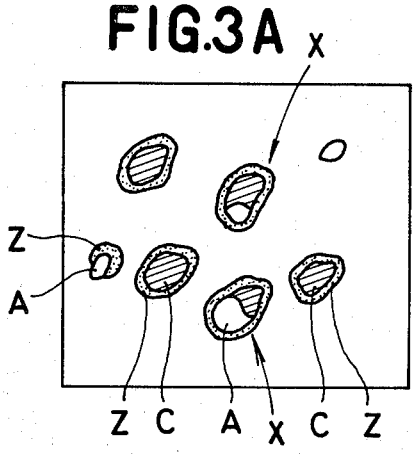
FIGS. 3A to 3D are enlarged schematics illustrating the de-ashing and pelletizing processes of Example 1 of this invention.

According to the principle of this invention, pulverized coal and binder are mixed in the dry pelletizer 7 so that the surfaces of coal particles are coated with the binder. This is schematically shown in FIG. 3A, in which coal particle C and ash particle A are coated by binder Z and coated particle X is formed.

During dry mixing, coal particles C are rubbed with each other and water and oxidized layer are removed from the coal particles. Thus, the film of binder Z is formed on the fresh surfaces of coal particles.

Figure 3B:
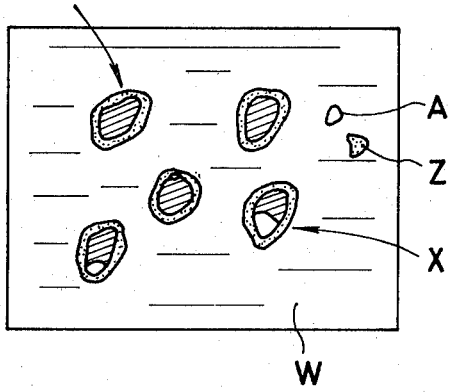

On addition of water W, followed by agitation, the binder separates from hydrophilic ash particle A, and thus bare ash particles disperse into water, as shown in FIG. 3B.

Figure 3C:
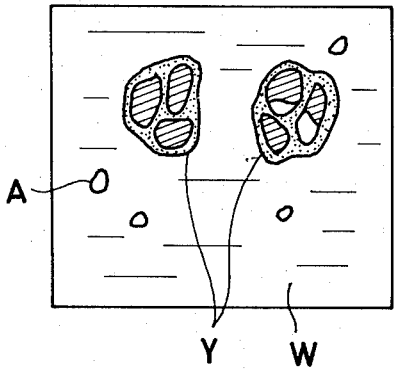

After continued agitation, coal particles X coated with binder Z agglomerate, forming agglomerate particles Y or pellets on tumbling in water, as shown in FIG. 3C.

The agglomerate particles Y are sieved out from the slurry containing ash particles A, and the resultant pellets 17 (FIG. 1) are shipped by slurry transportation or bulk transportation as mentioned earlier.

Figure 3D:
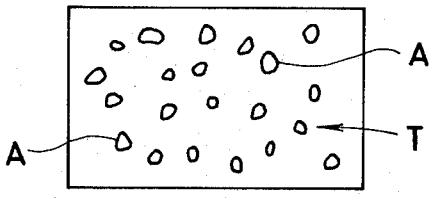

The slurry containing ash particles A, shown in FIG. 3D, is separated into ash particles 20 and clear water 21 by the solid-liquid separator 19, as mentioned above.

As is apparent from FIG. 3A to 3D, the process of this invention is characteristic in that the binder sticks to coal particles regardless of the degree of carbonization of raw coal.

Example 2 is described with reference to FIG. 4, in which the steps of preparing the slurry 15 containing pellets and ash particles from raw coal 1 and sieving the slurry are carried out in the same manner as in Example 1 (FIG. 1). The process of Example 2 includes the additional post-treatment step for improved de-ashing, in which the pellets 17 sieved out by the screen 16 are subjected to the gravity separator 35.

In other words, the process of Example 2 is intended to further de-ash the pellets 17 obtained in the process of Example 1, whereby to obtain purified pellets 36. Since the pellets 17 are more uniform in particle size as compared with conventional pulverized coal, de-ashing by gravity separation can be achieved effectively.

The purified pellets 36 contain more coal and carry more binder than pellets 17, and therefore have a lower specific gravity than pellets 17 and release ash easily.

In addition, the purified pellets 36 contain bubbles, although very small in quantity, and therefore float more easily than pellets 17. This property also improves the de-ashing by gravity separation.

When raw coal powder which is not pelletized is subjected directly to the conventional gravity separation, separation of coal and ash becomes blurred due to fine coal particles in the raw coal. In other words, the fine coal particles form a black slurry which prevents the separation of low-ash coal that floats and high-ash coal that settles down.

This Example 2 is intended to overcome the above-mentioned disadvantages and to produce purified pellets by effective de-ashing.

The process of Example 2 can be applied to raw coal such as bituminous coal and sub-bituminous coal containing 15 to 45 wt % of ash, and particularly to raw coal in which ash is present in the form of particles of 1 to 2 mm in size.

Figure 4:
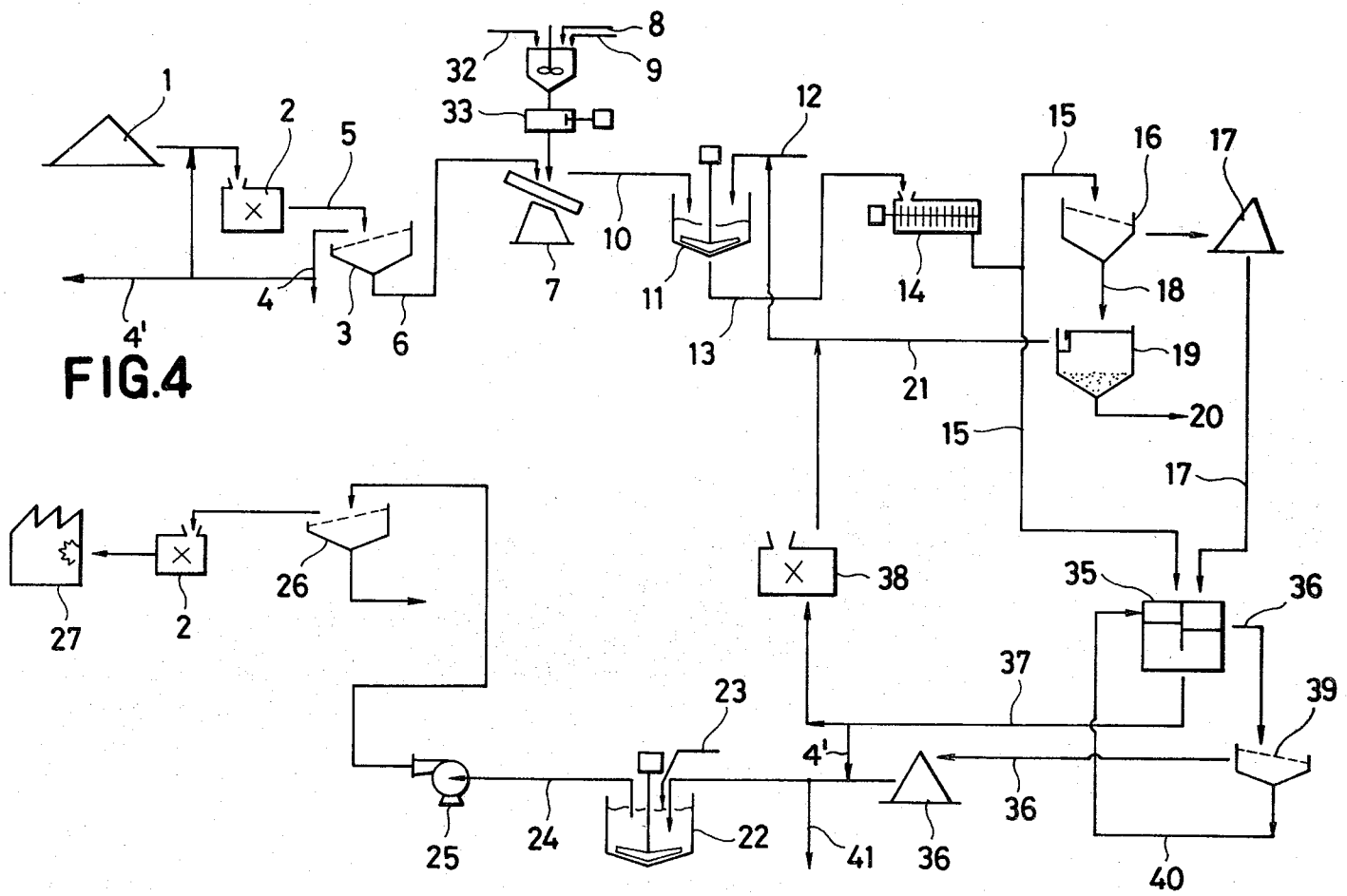
FIG. 4 is a flow diagram illustrating Example 2 of this invention.

Referring to FIG. 4, pellets 17 separated by screen 16 are introduced to gravity separator 35 in which purified pellets 36 float and high-ash pellets 37 settle down.

It is also possible to introduce pellet-ash slurry 15 directly into gravity separator 35.

It is to be noted that high-ash pellets 37 contain coal particles of such structure that carbon encloses ash particles, or contain ash particles of the same particle size as the pellets.

As the gravity separator 35, a heavy-media cyclone or water concentrator can be used. They are operated at a separation ratio of 90% floating and 10% settling based on the flow rate of the pellets.

The settle high-ash pellets 37 are disintegrated by the wet mill 38 and then recycled to the mixer 11. The floated purified pellets 36 pass through the solid-liquid separator 39 for separation of water 40, and then combined with fresh water, as in Example 1, for slurry transportation to the place of consumption. Instead of slurry transportation, the pellets 36 may be shipped by bulk transportation 41 as in Example 1.

Figure 5A:
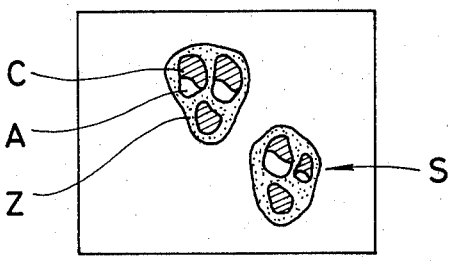
FIGS. 5A and 5B are enlarged schematics illustrating the principle of the process of Example 2 of this invention.
Figure 5B:
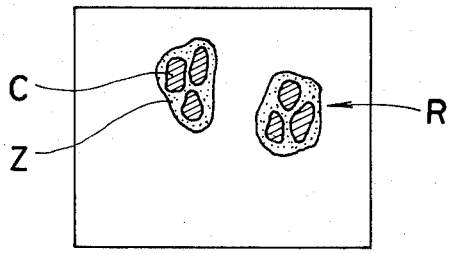

According to the principle of Example 2, the pellets Y shown in FIG. 3C (Example 1) are subjected to a gravity separator, whereby the high-ash pellets S containing ash as shown in FIG. 5A are separated from the purified pellets R as shown in FIG. 5B. The removal of high-ash pellets S improves the de-ashing ratio further.

Example 3 is described with reference to FIG. 6, in which the pretreatment steps of crushing raw coal and performing de-ashing by gravity separation are added to the process of Example 2. The process of Example 3 can be preferably applied to treatment of raw coal containing rock layers thicker than 1 mm and ash particles smaller than 1 mm.

As compared with the process of Example 2, the process of Example 3 is advantageous in that de-ashing is performed prior to addition of binder and therefore the content of pure coal at the time of binder addition is increased and the quantity of ash in de-ashing step after binder addition is decreased. In proportion to this decrease, the quantity of binder to be added can be reduced and pellets of high purity can be obtained at high yields.

Figure 6:
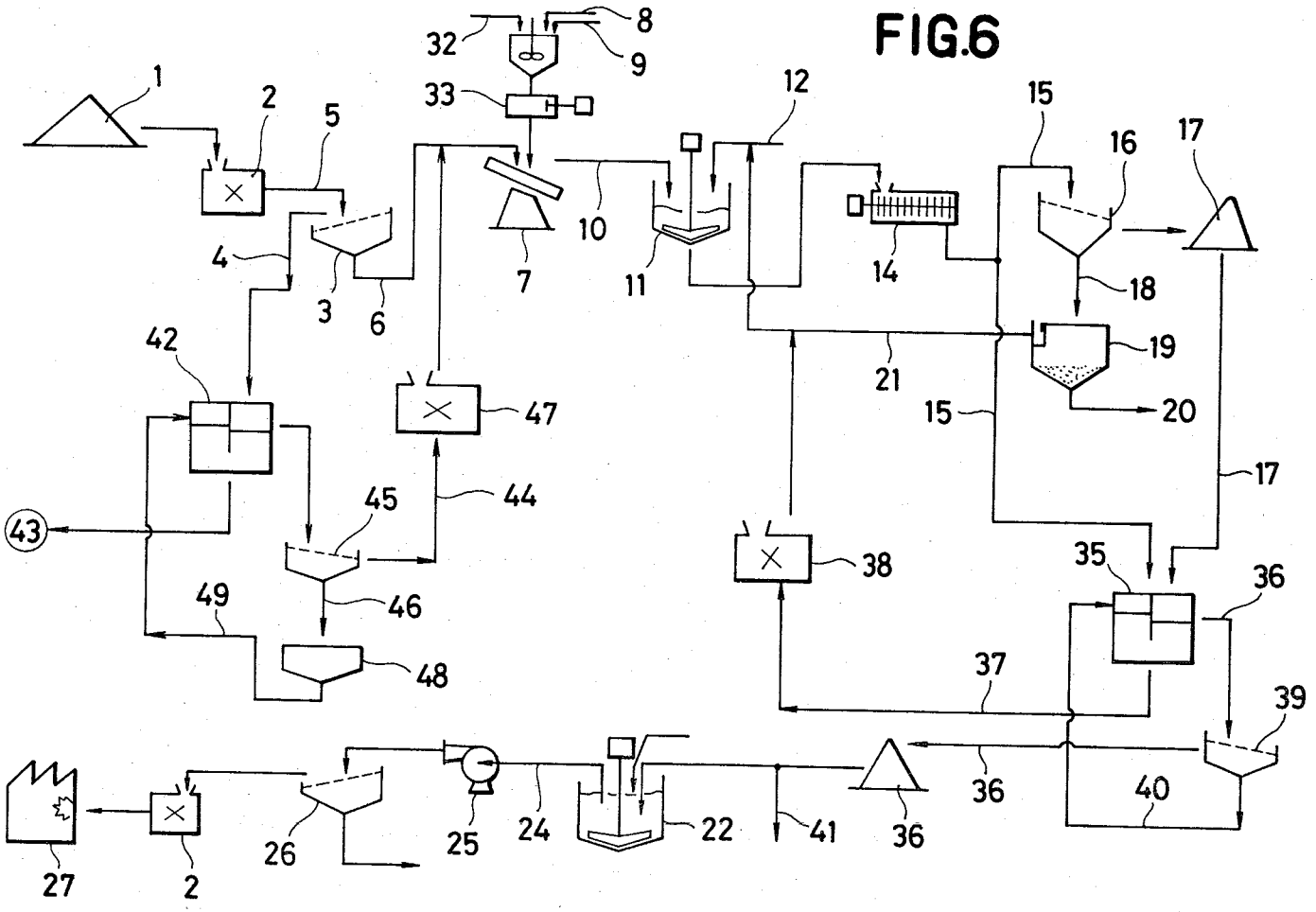
FIG. 6 is a flow diagram illustrating Example 3 of this invention.

In FIG. 6, raw coal 1 is crushed by the crusher 2 and then screened by the classifier 3. Lump coal in size from 7 to 100 mm is fed to the gravity separator 42, and fine coal 6 in size less than 7 mm is fed to the dry pelletizer 7.

As the gravity separator 42, a heavy-media cyclone or water concentrator can be used, as in the case of the gravity separator 35 used for post treatment in Example 2 (FIG. 4). The settled high-ash lump coal 43 is used for, for example, land reclamation.

On the other hand, the floated, de-ashed purified lump coal 44 is separated from water 46 by the solid-liquid separator 45, crushed into particles smaller than 7 mm, 0.5 to 0.8 mm on average, by the crusher 47, and then fed to the dry pelletizer 7. Thereafter, the pellets undergo the same treatment as in Example 2 (FIG. 4).

The water 46 separated from the solid-liquid separator 45 still contains suspending fine coal particles; it is purified by the thickener 48 and the purified water 49 is recycled to the gravity separator 42.

Example 4 is described with reference to FIG. 7, in which the pretreatment process for de-ashing crushed raw coal by a gravity separator is added to the process of Example 1 (FIG. 1). This de-ashing pretreatment process is performed in the same manner as the de-ashing pretreatment in Example 3 (FIG. 6).

The process of Example 4 can be applied to the treatment of raw coal containing rock layers greater than 1 mm, providing an economical effect that the quantity of discarded coal is decreased and the yield of coal is improved.

The present invention has the following effects.

(1) Since the binder is applied directly to the surface of pulverized coal particles by dry agitation, the sticking of binder is not affected by the rank of coal or the degree of lipophilic property of coal. Thus, it is possible to apply the de-ashing and pelletizing treatment to brown coal to which the conventional process has not been applicable.

(2) The dry mixing of coal particles and binder provides good sticking of binder in thin film to the surface of coal particles. It is also possible to prevent the binder from being discharged into slurry from ash particles. This saves the consumption of binder by 40 to 60% as compared with the conventional process in which the binder is added to the fine coal slurry.

(3) In the conventional process, it is necessary to stir a large quantity of slurry medium (water) with a great deal of power energy in order to attain oil to coal particles by adding oil to coal slurry, whereas according to the present invention, the binder is attached directly to coal particles in air and consequently the power requirement can be reduced to an extreme extent.

(4) According to the conventional OAW method, it is difficult to carry out de-ashing and pelletizing when the surfaces of coal particles are oxidized and less lipophilic, whereas according to the present invention, coal particles are rubbed with each other and the oxidized layer is removed when the binder is added. Therefore, oxidation of coal particles causes no problem.

(5) In the case of coal particles carrying a large amount of water, the surface water is replaced by the binder. Thus, it is possible to attach binder while carrying out dewatering.

(6) Ash such as soil and rocks in coal is allowed to disperse into water by utilizing the hydrophilic property of ash which permits water to be adsorbed with a force as high as 10,000 kg/cm$^2$ in terms of pressure. Because of this hydrophilic property, ash particles which have been once enclosed with the binder release the binder into water. Thus, de-ashing can be performed effectively irrespective of the kind of coal.

(7) According to the present invention, de-ashing treatment by gravity separation can be combined depending on the state of presence of ash in raw coal, the size of ash particles, and the content of ash. Thus, it is possible to remove by sedimentation ash particles enclosed by pure coal which cannot be removed by the conventional method. Sink float separation can be performed more effectively for uniform pellets than for as-received coal particles.

(8) In addition, according to the present invention, coal and binder are recovered by recrushing high-ash coal separated by gravity separation. This increases the de-ashing ratio and the yield of pure coal and decreases the usage of binder.

(9) Slurry transportation or bulk transportation of pellets containing reduced ash saves the waste of transporting ash. In addition, according to the present invention, pipelines for slurry transportation are protected effectively from corrosion, and the pellets with ash removed and with surface coated with binder (oil) float well during slurry transportation. Pellets can be easily dewatered at the terminal of pipelines for slurry transportation.

(10) Bulk transportation in the form of pellets prevents almost completely dust from occurring.

(11) The process of this invention can be applied without any modification to coking coal as well as steaming coal. The process of this invention is also applicable to oil shale, brown coal, sub-bituminous coal, and bituminous coal.

The invention will be described in detail with reference to the following examples.

EXAMPLE 1

The process of this invention was evaluated by operating a pilot plant according to the flow diagram shown in FIG. 1, with a coal flow rate of 100 kg/h in the de-ashing and pelletizing processes from the crusher 2 to the screen 16.

(1) De-ashing ratio

The de-ashing ratio in relation to the stirring time in the dry agitator 7 was investigated for brown coal produced in the arctic zone. The raw coal was pulverized to an average particle size of 0.7 mm.

Figure 8:
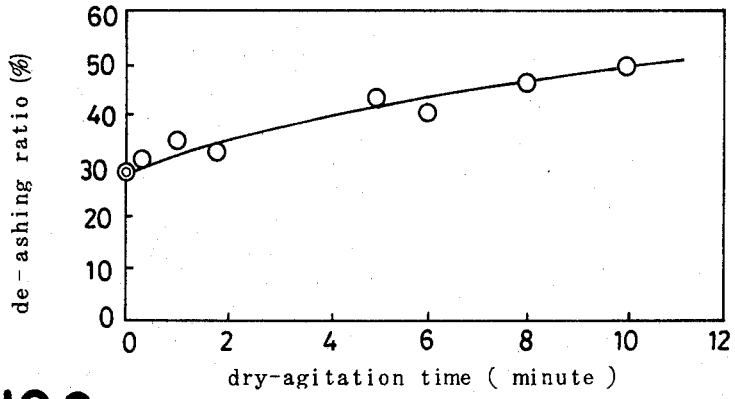
FIG. 8 is a graph showing the relation between the de-ashing ratio and the dry agitation time in Example 1 of this invention.

The results are shown in FIG. 8. In FIG. 8. the double circle at the zero agitation time indicates the result of operation in which dry agitation was omitted and only the wet forming machine 14 was used in the same manner as in the conventional OAW process. The power consumption (kW) throughout the entire process was the same.

It is to be noted from FIG. 8 that the conventional method achieved 30% of de-ashing ratio, whereas the process of this invention having the dry agitator 4 improved the de-ashing ratio to about 50%.

Incidentally, the de-ashing ratio ($\eta$) is defined as follows:

$$(\eta)=1-(A_a\times R)/A_r$$

where $A_a$:ash content in pellets $A_r$:ash content in raw coal

R:yield (2) Pure coal yield

Figure 9:
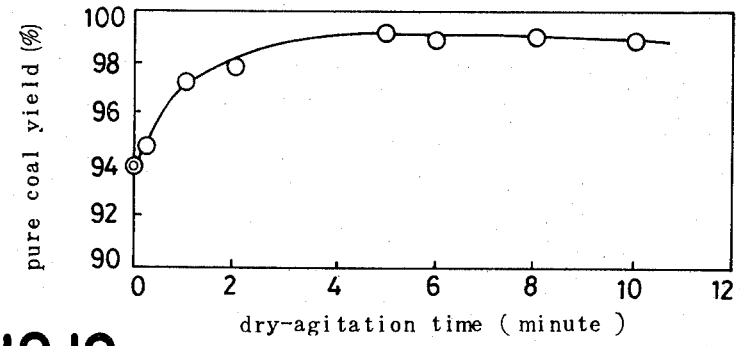
FIG. 9 is a graph showing the relation between the pure coal yield and the dry agitation time in Example 1 of this invention.

As in above (1), the relation between the de-ashing ratio and the dry agitation time was investigated. Results are shown in FIG. 9. It is to be noted from FIG. 9 that the yield was improved from 94% to 99%.

(3) Quantity of oil discharged into waste water

As in above (1), the relation between the quantity of oil discharged into waste water (% of oil added) and the agitation time. Results are shown in FIG. 10.

Figure 10:
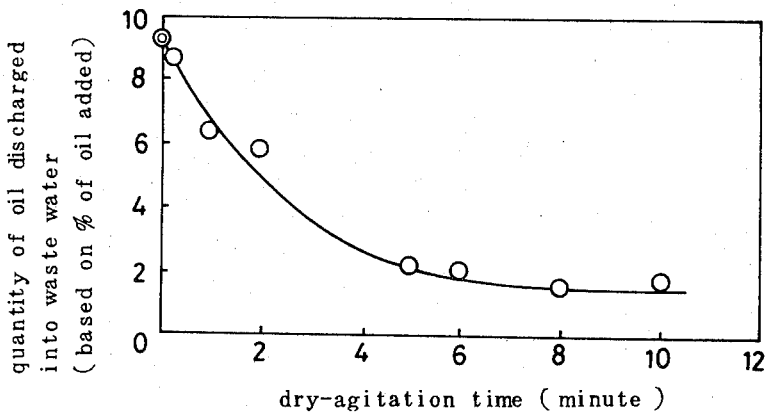
FIG. 10 is a graph showing the relation between the quantity of oil discharged into waste water and the dry agitation time in Example 1 of this invention.

It is to be noted from FIG. 10 that the quantity of oil discharged was greatly improved from about 9% to about 1.5%.

In the above investigations from (1) to (3), the process of this invention required about one half the power for the conventional OAW method to achieve the same result (indicated by the double circle). This is because the conventional process needs vigorous agitation of water to attach oil to coal particles, whereas the process of this invention needs no water agitation.

EXAMPLE 2

The same experiment as Example 1 was carried out for high-ash bituminous coal produced in Australia, using fuel oil C as the binder. Results are shown in Table 1.

TABLE 1

| | | |
|---|---|---|
| Raw coal | | |
| Water content (wt %) | 5.0 | |
| Ash content (wt %) | 36.0 | |
| Average particle size (mm) | 0.085 | |
| | Conventional process | Process of the invention |
| Binder added (% on raw coal) | 19.0 | 12.0 |
| Ash in pellets (wt %) | 13.0 | 12.5 |

It is to be noted that the quantity of binder to achieve the same de-ashing ratio was reduced almost by half in the process of this invention as compared with the conventional process.

EXAMPLE 3

The same experiment as Example 1 was carried out for high-water brown coal produced in Australia. Results are shown in Table 2.

TABLE 2

| | | |
|---|---|---|
| Raw coal | | |
| Water content (wt %) | 60 | |
| Ash content (wt %) | 4.8 | |
| Average particle size (mm) | 0.285 | |
| | Conventional process | Process of the invention |
| Kind and quantity of binder added (%) | Coal tar 30 | Fuel oil C 16 |
| Water in pellets (wt %) | 15.0 | 12.0 |
| Ash in pellets (wt %) | 2.5 | 2.9 |

In the conventional process, it was impossible to produce pellets with 30 wt % of fuel oil C, and it was only possible to produce pellets with 30 wt % of coal tar. This means that the conventional process is industrially unfavorable in recent years when coal tar is not available in large quantities.

In the process of this invention, it was possible to produce pellets with half as much binder (fuel oil C) as in the conventional process.

The relation between the quantity of fuel oil added and the particle size of pulverized raw coal was investigated. Results are shown in FIG. 11.

The particle size distribution of raw coal was such that the slope of Rosin-Rammler distribution is about 45° ($\tan\theta=1$).

Figure 11:
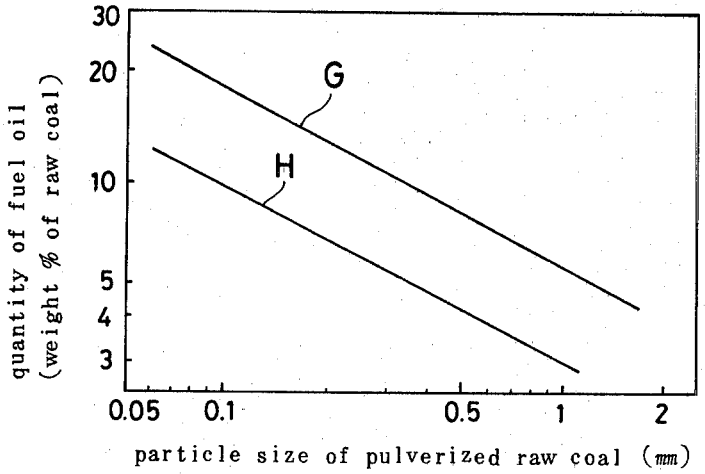
FIG. 11 is a graph showing the relation between the quantity of fuel oil and the particle size of pulverized raw coal in Example 1 of this invention.

FIG. 11 indicates that the binder in the process of this invention (line H) is nearly halved as compared with the conventional OAW process (line G).

EXAMPLE 4

In the process of this Example shown in FIG. 4, the post-treatment step by gravity separation was added to the process shown in FIG. 1.

Using the same raw coal as in Example 2, the relation between gravity separation and ash content of pellets was investigated. Results are shown in FIGS. 12 and 13.

Figure 12:
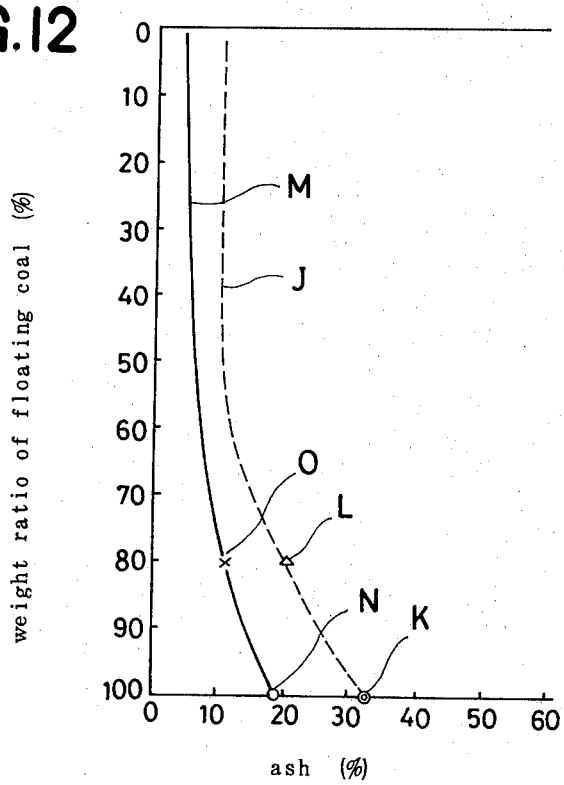
FIG. 12 and FIG. 13 are graphs showing the relation between the weight ratio of floating coal and the ash content in Example 2 of this invention.
Figure 13:
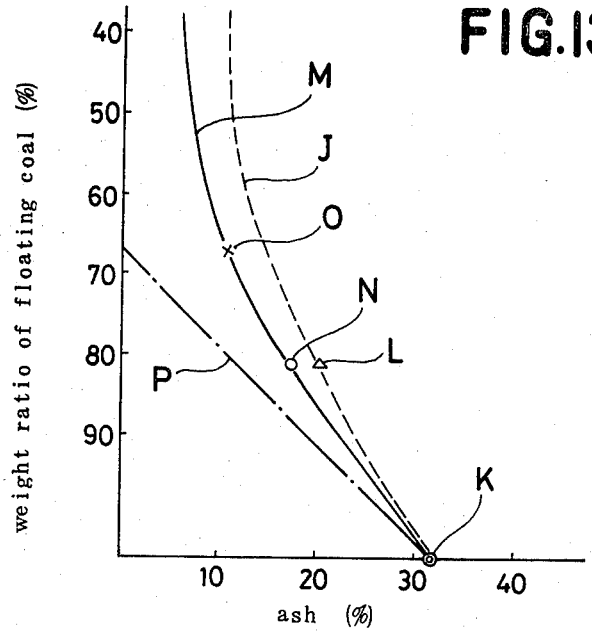

In FIGS. 12 and 13, point K (indicated by a double circle) on curve J indicates the ash content of raw coal (33 wt %). The broken line from point K to point L (indicated by a triangle) is the so-called gravity separation curve of raw coal. In the conventional gravity separation of raw coal, purified coal containing 20 wt % ash represented by point L can be obtained if settled coal amounting to 20 wt % of the total coal is discarded. However, the discarded coal still contain about 15 wt % of pure coal and the discard gives rise to a great problem in energy economy and environmental protection.

Point N (indicated by a circle) on curve M indicates the ash content of pellets (pellets 17 in FIG. 4) prior to gravity separation in the process of this invention. The curve from point N to point O (indicated by an X) is the gravity separation curve of the pellets. This curve indicates that according to the process of this invention it is possible to reduce the ash content to 11 wt % for the purified pellets defined by point O. Settled coal or high-ash pellets to be recycled to the de-ashing step 14 after crushing contain about 45% of pure coal which corresponds to about 7 wt % of coal before treatment. This pure coal is recovered in the steps from mixer 11 to separator 19 in FIG. 4.

Incidentally, in FIG. 13, chain line P indicates an imaginary line for 100% yield of pure coal.

According to the process of this invention, it is possible to accomplish a very high de-ashing ratio while reducing by half the quantity of binder and keeping the yield higher than 98%.

EXAMPLE 5

In the process of this Example shown in FIG. 6, the pre-treatment step by gravity separation was added to the process shown in FIG. 4.

Figure 14:
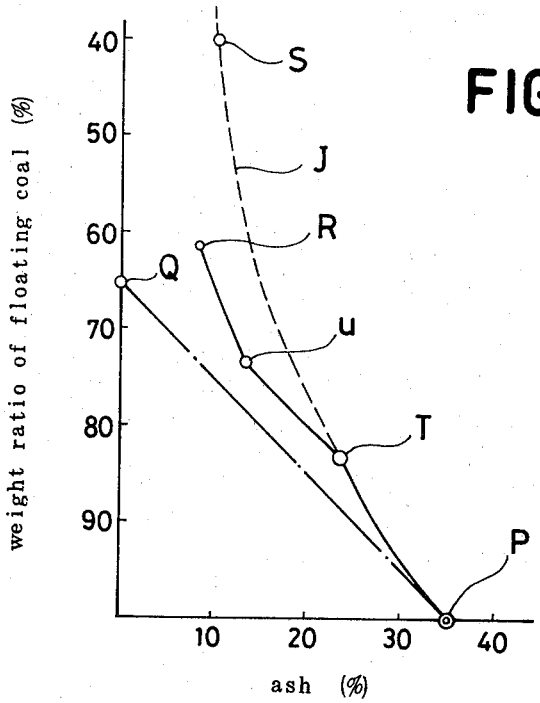
FIG. 14 and FIG. 15 are graphs showing the relation between the weight ratio of floating coal and the ash content in Example 3 and Example 4 of this invention, respectively.

FIG. 14 shows the relation between the ash content and the weight ratio of floating coal of the resulting pellets.

In this Example, high-ash bituminous coal containing 35 wt % ash was used.

In FIG. 14, broken line J from point P (raw coal) to point S via point T represents the flotation curve of lump coal obtained by crushing raw coal to 20 to 100 mm size. As compared with FIG. 13, this curve J greatly deviates from the imaginary line PQ representing 100% yield of pure coal.

As shown in FIG. 6, raw coal is subjected to gravity separation so as to obtain purified coal (represented by T in FIG. 14) containing 23 wt % ash. This purified coal undergoes dry pelletizing and underwater forming to yield pellets containing 13 wt % ash as represented by U in FIG. 14. The pellets U are then subjected to gravity separation to yield purified pellets as final products containing ash less than 10 wt % (represented by R).

If it is attempted to obtain purified coal containing 10 wt % ash simply by subjecting raw coal (point P) to gravity separation, the yield is 40 wt % as indicated by point S, whereas the process shown in FIG. 6 makes it possible to increase the yield to 62% (point R) with a significant economical effect.

EXAMPLE 6

Figure 7:
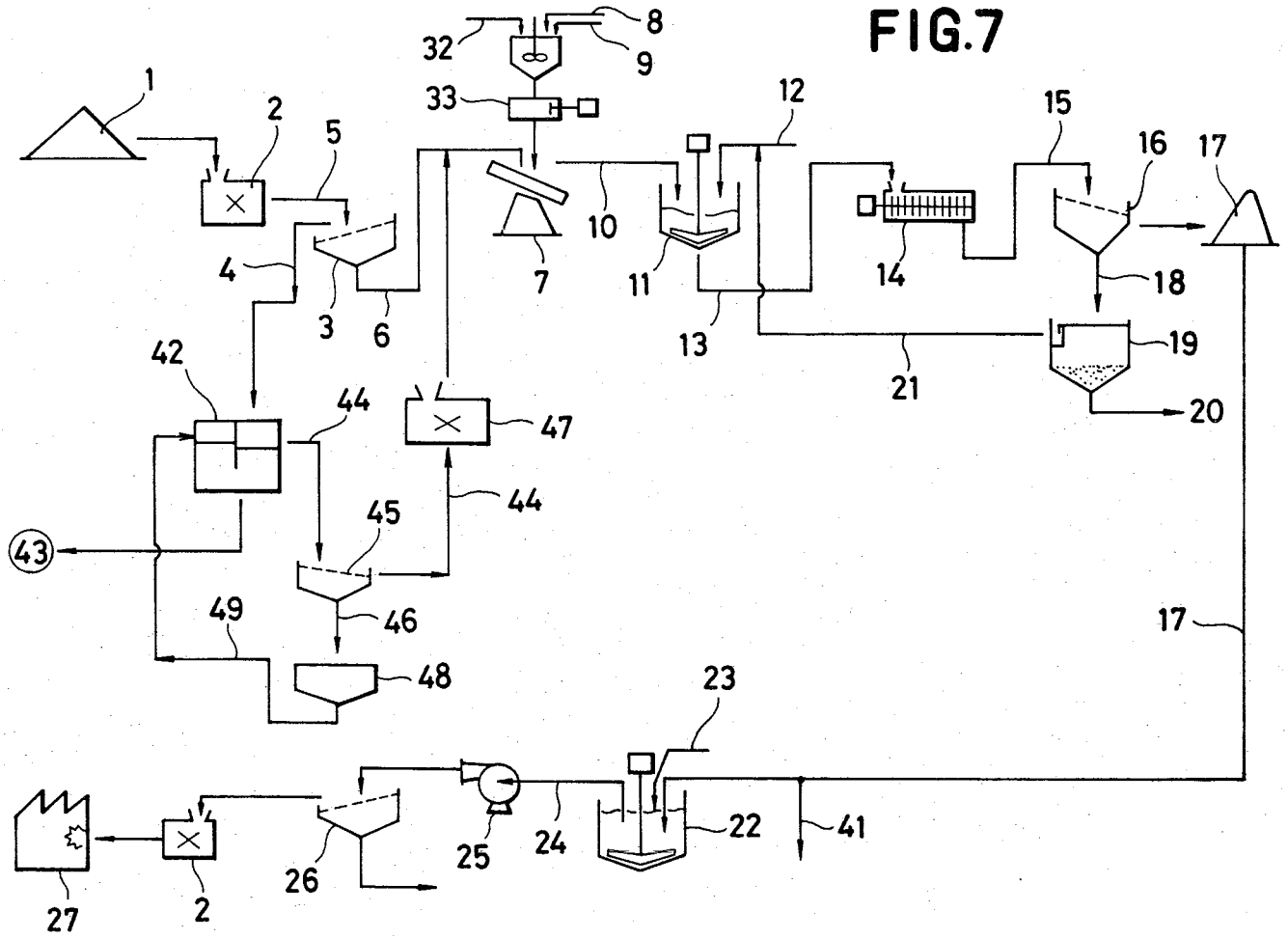
FIG. 7 is a flow diagram illustrating Example 4 of this invention.

In the process of this Example shown in FIG. 7, the pre-treatment step for de-ashing by gravity separation was added to the process shown in FIG. 1.

Figure 15:
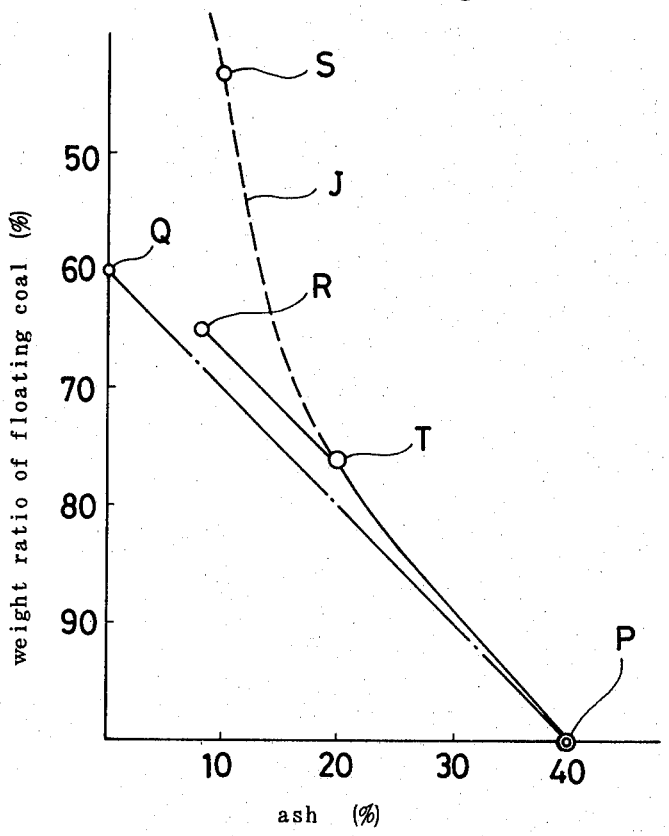

FIG. 15 shows the relation between the ash content and the weight ratio of floating coal of the resulting pellets.

In this Example, high-ash bituminous coal containing 40 wt % ash was used.

In FIG. 15, the straight line drawn from point P representing ash content of raw coal to point Q representing 60 wt % yield of floated coal represents the imaginary line for 100% yield of pure coal. The broken line J from point P to point S via point T represents the flotation curve of lump coal obtained by crushing raw coal to 20 to 100 mm size.

So long as the flotation curve J is close to the straight imaginary line for 100% yield of pure coal, or in the range in which ash content is decreased from 40 wt % to 20 wt %, it is adequate to subject raw coal to gravity separation. In other words, raw coal undergoes gravity separation until 77% yield (point T) is achieved, and the floating purified coal undergoes dry pelletizing and underwater forming. The coal is further de-ashed from point T to point R, and purified pellets containing 9 wt % ash can be obtained.

If it is attempted to obtain purified coal containing 10 wt % ash simply by subjecting raw coal to gravity separation as shown in curve J from point P to point S via point T, the yield is less than 50 wt % as indicated by point S, whereas the process shown in FIG. 7 makes it possible to increase the yield to 66% (from point P to point R via point T) with a saving of discarded coal and improved economy.

EXAMPLE 7

Slurry transportation was investigated using the pellets obtained in Example 1.

In view of the fact that pipes used for slurry transportation of pellets are larger in diameter than those used for slurry transportation of dust coal, one is inclined to think that slurry transportation of pellets requires a greater critical flow rate and involves difficulties accordingly.

However, it was confirmed in the pilot plant of Example 1 that pellet slurry of 50 wt % solids can be transported satisfactorily through a pipe having a nominal diameter of 3B (3 inches) and a total length of 100 meters, at a flow rate of 1.5 m/s which is the standard flow rate for dust coal slurry. This results from the fact that pellets have a low true specific gravity because they are free of heavy ash ($\rho \geqq 2$) and contains fuel oil ($\rho = 0.9$ to 0.95) and air which has been entrapped in voids during the dry agitation process.

In the case of coal slurry containing powder of bituminous coal produced in Eastern Australia, the resulting slurry is acid at pH 3 to 5 and corrodes pipelines. However, the slurry carrying the same coal which has been formed into pellets is neutral at pH 7.3 and does not corrode pipelines.

The pellets obtained in Example 1 were passed through the centrifugal pump in the pilot plant 185 times and passed through the piping for 9 hours to see if the pellets are pulverized during slurry transportation. It was found that particles smaller than 0.5 mm in size were formed in an amount of about 10% based on the total quantity of pellets larger than 0.5 mm in size. It was also found that the fine particles formed by disintegration are still agglomerates and are not particles of size in microns which cause trouble in the dewatering process.

It has been proved that the process of this invention is superior to the conventional OAW arranged at the terminal of a pipeline for dust coal slurry. Needless to say, the process of this invention has a significant effect that the wase of transporting ash is reduced.

What is claimed is:

1. A method of de-ashing and transporting coal comprising the steps of:
   (1) dry mixing pulverized coal particles with a hydrocarbonaceous binder to cover the surfaces of the particles with the binder,
   (2) adding water to the binder-covered pulverized coal to form an aqueous slurry of coal particles,
   (3) stirring the slurry, so as to disperse ash particles from the pulverized coal into the water and to agglomerate coal particles of the pulverized coal by tumbling, thereby forming pelletized coal,
   (4) separating ash particles from the pelletized coal, and
   (5) transporting the separated pelletized coal.

2. A method of de-ashing and transporting coal comprising the steps of:
   (1) crushing coal and separating the resulting crushed coal into finer pulverized coal particles and larger crushed coal particles,
   (2) dry mixing the above separated pulverized coal particles with a hydrocarbonaceous binder to cover the surfaces of the particles with the binder,
   (3) adding water to the binder-covered pulverized coal to form an aqueous slurry of coal particles,
   (4) stirring the slurry, so as to disperse ash particles from the pulverized coal into the water and to agglomerate coal particles in the pulverized coal by tumbling, thereby forming pelletized coal,
   (5) separating the pelletized coal from ash particles,
   (6) mixing the separated pelletized coal with the larger crushed coal particles obtained in step (1), and
   (7) transporting the resulting mixture.

3. A method of de-ashing and transporting coal comprising the steps of:
   (1) dry mixing pulverized coal particles with a hydrocarbonaceous binder to cover the surfaces of the particles with the binder,
   (2) adding water to the binder-covered pulverized coal to form an aqueous slurry of coal particles,
   (3) stirring the slurry, so as to disperse ash particles from the pulverized coal into the water and to agglomerate coal particles in the pulverized coal by tumbling, thereby forming pelletized coal,
   (4) separating the pelletized coal from the ash particles,
   (5) separating the separated pelletized coal by gravity separation into high ash pelletized coal and pure pelletized coal, and (6) transporting the separated pure pelletized coal.

4. A method of de-ashing and transporting coal comprising the steps of:

(1) crushing coal and separating the resulting crushed coal into finer pulverized coal particles and larger crushed coal particles, (2) dry mixing the separated pulverized coal particles with a hydrocarbonaceous binder to cover the surfaces of the particles with the binder, (3) adding water to the binder-covered pulverized coal to form an aqueous solution of coal particles, (4) stirring the slurry, so as to disperse ash particles from the pulverized coal into the water and to agglomerate coal particles in the pulverized coal by tumbling, thereby forming pelletized coal, (5) separating ash particles from the pelletized coal, (6) separating the separated pelletized coal by gravity separation into high ash pelletized coal and pure pelletized coal, (7) mixing the separated pure pelletized coal with the larger crushed coal particles obtained in the step (1), and (8) transporting the resulting mixture.

5. A method of de-ashing and transporting coal comprising the steps of:

(1) crushing coal and separating the resultant crushed coal into larger crushed coal particles and finer pulverized coal particles, (2) separating the separated larger crushed coal particles by gravity separation into high ash crushed coal particles and pure crushed coal particles, (3) pulverizing the separated pure crushed coal particles and mixing the resulting pulverized pure coal particles with the fine pulverized coal particles obtained in step (1), (4) dry mixing the resulting mixture of pulverized coal particles with a hydrocarbonaceous binder to cover the surfaces of the particles with the binder, (5) adding water to the binder-covered pulverized coal to form an aqueous solution of coal particles, (6) stirring the slurry, so as to disperse ash particles in the pulverized coal into the water and to agglomerate coal particles in the pulverized coal by tumbling, thereby forming pelletized coal, (7) separating ash particles from the pelletized coal, (8) separating the separated pelletized coal by gravity separation into high ash pelletized coal and pure pelletized coal, and (9) transporting the separated pure pelletized coal.

6. A method of de-ashing and transporting coal comprising the steps of:

(1) crushing coal and separating the resultant crushed coal particles and finer pulverized coal particles, (2) separating the separated larger crushed coal particles by gravity separation into higher ash crushed coal particles and pure crushed coal particles, (3) pulverizing the separated pure crushed coal particles and mixing the resulting pulverized coal particles with the pulverized coal particles obtained in step (1), (4) dry mixing the resulting mixture of pulverized coal particles with a hydrocarbonaceous binder to cover the surface of the particles with the binder, (5) adding water to the binder-covered pulverized coal to form an aqueous solution of coal particles, (6) stirring the slurry, so as to disperse ash particles from the pulverized coal into the water and to agglomerate coal particles in the pulverized coal by tumbling, thereby forming pelletized coal, (7) separating ash particles from the pelletized coal, and (8) transporting the separated pelletized coal.

7. A method for de-ashing and transportation of coal as set forth in any one of claims 1 to 6, wherein the binder is selected from the group consisting of coal-derived artificial petroleum, coal tar, petroleum hydrocarbon oil, and asphalt.

8. A method for de-ashing and transportation of coal as set forth in any one of claims 1 to 6, wherein the binder is a mixture of a surface active agent and a member selected from the group consisting of coal-derived artificial petroleum, coal tar, petroleum hydrocarbon oil, and asphalt.

9. A method for de-ashing and transportation of coal as set forth in any one of claims 1 to 6, wherein the binder is an emulsion prepared by adding water to a mixture of a surface active agent and a member selected from the group consisting of coal-derived artificial petroleum, coal tar, petroleum hydrocarbon oil, and asphalt.

10. A method for de-ashing and transportation of coal as set forth in any one of claims 1 to 6, wherein the binder is an oil-coal mixture prepared by adding 30 to 60 wt % of fine coal powder to a mixture of a surface active agent and a member selected from the group consisting of coal-derived artificial petroleum, coal tar, petroleum hydrocarbon oil, and asphalt.

11. A method for de-ashing and transportation of coal as set forth in any one of claims 1 to 6, wherein the binder is an oil-coal mixture prepared by adding 30 to 60 wt % of fine coal powder obtained by pulverizing pelletized coal or purified pelletized coal into fine particles smaller than 10 microns, to a mixture of a surface active agent and a member selected from the group consisting of coal-derived artificial petroleum, coal tar, petroleum hydrocarbon oil, and asphalt.

12. A method for de-ashing and transportation of coal as set forth in any one of claims 3 to 5, wherein the high-ash pellets are crushed and the resulting powder is dispersed into water together with the pulverized raw coal.

13. A method for de-ashing and transportation of coal as set forth in any one of claims 1 to 6, wherein the pellets undergo slurry transportation.

14. A method for de-ashing and transportation of coal as set forth in any one of claims 1 to 6, wherein the pellets undergo bulk transportation.

* * * * *